US010821588B2

(12) United States Patent
Li

(10) Patent No.: US 10,821,588 B2
(45) Date of Patent: Nov. 3, 2020

(54) MAGNETIC STAPLER

(71) Applicant: PARRIC NINGBO STATIONERY AND GIFTS MFG. CO., LTD, Ningbo, Zhejiang Province (CN)

(72) Inventor: Fuping Li, Ningbo (CN)

(73) Assignee: PARRIC NINGBO STATIONERY AND GIFTS MFG. CO., LTD, Ningbo, Zhejiang Province (CN)

( * ) Notice: Subject to any disclaimer, the term of this patent is extended or adjusted under 35 U.S.C. 154(b) by 353 days.

(21) Appl. No.: 15/776,178

(22) PCT Filed: Nov. 16, 2016

(86) PCT No.: PCT/CN2016/106106
§ 371 (c)(1),
(2) Date: May 15, 2018

(87) PCT Pub. No.: WO2017/084578
PCT Pub. Date: May 26, 2017

(65) Prior Publication Data

US 2020/0262043 A1 Aug. 20, 2020

(30) Foreign Application Priority Data

Nov. 16, 2015 (CN) ..... 2015 1 0785546

(51) Int. Cl.
*B25C 7/00* (2006.01)
*B25C 5/02* (2006.01)

(52) U.S. Cl.
CPC ..... *B25C 7/00* (2013.01); *B25C 5/0235* (2013.01)

(58) Field of Classification Search
CPC ..... B25C 5/02; B25C 5/11; B25C 7/00
(Continued)

(56) References Cited

U.S. PATENT DOCUMENTS 2,763,862 A * 9/1956 Maceachron ..... B25C 5/02 72/481.1
4,925,082 A 5/1990 Jin
(Continued)

FOREIGN PATENT DOCUMENTS

CN 2068907 U 1/1991
CN 201192934 Y 2/2009
(Continued)

OTHER PUBLICATIONS

International Search Report issued in International Application No. PCT/CN2016/106106, dated Feb. 8, 2017.
(Continued)

*Primary Examiner* — Nathaniel C Chukwurah
(74) *Attorney, Agent, or Firm* — Charles C. Achkar; Ostrolenk Faber LLP.

(57) ABSTRACT

A magnetic stapler includes a base plate, a positioning plate, and a stapler. The positioning plate is located between the base plate and the stapler. A groove is provided on the positioning plate. The contour of the groove fits the bottom of the stapler. Multiple first magnets are provided at the periphery of the positioning plate. Multiple second magnets corresponding respectively to the first magnets are provided on the base plate. The polarity of the second magnets is opposite to that of the first magnets. A staple-crimping platform is provided on the base plate. A staple dispensing outlet corresponding to a staple dispensing extremity of the stapler is provided at the bottom thereof. The position of the staple-crimping platform is opposite to the position of the staple dispensing outlet. The magnetic stapler has the advantages of being compact as a whole, easy to operate, and strongly practical and is capable of stapling at any position on sheets of paper.

20 Claims, 7 Drawing Sheets

(58) Field of Classification Search
USPC ..... 227/8, 120
See application file for complete search history.

(56) References Cited

U.S. PATENT DOCUMENTS

| | | | | |
|---|---|---|---|---|
| 2003/0178464 | A1* | 9/2003 | Sinisi | B25C 5/0235 227/134 |
| 2010/0206936 | A1 | 8/2010 | Oh | |

FOREIGN PATENT DOCUMENTS

| | | | |
|---|---|---|---|
| CN | 105234900 | A | 1/2016 |
| CN | 205085928 | U | 3/2016 |
| JP | 2015127086 | A | 7/2015 |

OTHER PUBLICATIONS

Written Opinion of the International Searching Authority issued in International Application No. PCT/CN2016/106106, dated Feb. 8, 2017.

* cited by examiner

MAGNETIC STAPLER

FIELD OF THE INVENTION

The present invention relates to a stapler, and more particularly to a magnetic stapler.

BACKGROUND OF THE INVENTION

A stapler is used to join paper sheets together by driving a thin metal staple through the sheets. Staplers are widely used in offices, homes and schools.

At present, there is a magnetic stapler having a detachable base on the market. Through magnets provided at the base and the bottom of the stapler body to attract each other, the paper sheets are retained and then stapled at any position on the paper sheets. For example, China Utility Model No. 201320874243.9 discloses a magnetic stapler, consisting of a press cover, a staple groove, a staple, a slider, a push spring, a base, a magnet, and a rotary shaft. The inside of the press cover is hollow, and is provided with a metal sheet and the push spring. The lower end is provided with the staple groove. The inner wall of the rear end is provided with a set of bosses. The outside is connected with the rotary shaft. The inside of the staple groove is hollow and is provided with the staple, the slider and the push spring. The inner wall of the front end is formed with a gap. The rear end is provided with a set of notches. The left side is provided with a magnet. The upper end face of the base is provided with a press staple groove. The left side is provided with a magnet. The rear end is connected with the magnet. There are four magnets. The magnets disposed at the left side of the staple groove and the left side of the base are in the form of a thin plate. The magnets disposed at the rear end of the base and the lower end of the rotary shaft are in the form of a large square block. The left side is provided with a calibration line. When in use, the press cover is first turned up, the staple is placed into the staple groove, and then the paper sheets are placed on the base. After that, the press cover and the staple groove are placed on the paper sheets, and the magnets at the rear end and the left sides are aligned, enabling the press cover, the staple groove and the base to be aligned. Finally, the press cover is pressed, the metal sheet in the press cover presses the staple, and the staple passes through the paper sheets to join the paper sheets together. However, the base of the magnetic stapler is covered by the paper sheets. When the stapler needs to be attracted to the base, it is unable to find the position quickly and accurately. As a result, the stapling position may be deflected to damage the paper sheets, or because the position is not accurate, it is necessary to staple the paper sheets repeatedly.

SUMMARY OF THE INVENTION

1. Technical Problems to be Solved

The purpose of the present invention is to solve the above problems in the prior art and to provide a magnetic stapler to overcome the problems. The base of the conventional magnetic stapler is covered by paper sheets. When the stapler needs to be attracted to the base, it is unable to find the position quickly and accurately. As a result, the stapling position may be deflected to damage the paper sheets, or because the position is not accurate, it is necessary to staple the paper sheets repeatedly.

2. Technical Solution

To solve the above technical problems, the present invention provides a magnetic stapler. The magnetic stapler comprises a base plate, a positioning plate, and a stapler. The positioning plate is located between the base plate and the stapler. The positioning plate is transparent. A groove is provided on the positioning plate. The groove has a contour corresponding to that of a bottom of the stapler. A periphery of the positioning plate is provided with a plurality of first magnets.

The base plate is provided with a plurality of second magnets respectively corresponding to the first magnets. The second magnets have a polarity opposite to that of the first magnets. The base plate is provided with a staple-crimping platform thereon. The bottom of the stapler is provided with a staple dispensing outlet corresponding to a staple dispensing extremity of the stapler. The position of the staple-crimping platform is opposite to the position of the staple dispensing outlet.

Wherein, in the magnetic stapler, an inner side of the groove is provided with a plurality of engaging protrusions. An outer side of the bottom of the stapler is provided with a plurality of engaging recesses corresponding to the engaging protrusions. The engaging protrusions are engaged with the engaging recesses.

Wherein, in the magnetic stapler, an inner side of the groove is provided with a plurality of engaging recesses. An outer side of the bottom of the stapler is provided with a plurality of engaging protrusions corresponding to the engaging recesses. The engaging protrusions are engaged with the engaging recesses.

Wherein, in the magnetic stapler, the base plate is provided with a plurality of magnet accommodating cavities respectively corresponding to the second magnets. The second magnets are embedded in the magnet accommodating cavities, respectively.

Wherein, in the magnetic stapler, the magnet accommodating cavities each have a through hole at a bottom thereof for disassembling a corresponding one of the second magnets.

Wherein, in the magnetic stapler, the base plate and the bottom of the stapler are respectively provided with magnets corresponding in position to each other and attracting each other.

Wherein, in the magnetic stapler, the base plate is provided with calibration lines. The calibration lines are arranged close to both side edges of the base plate.

Wherein, the positioning plate is a movable structure.

Wherein, the positioning plate includes a first positioning plate and a second positioning plate. A sliding mechanism is provided between the first positioning plate and the second positioning plate. The first positioning plate is movably connected to the second positioning plate through the sliding mechanism.

Wherein, the sliding mechanism includes a guide rail and a guide groove to cooperate with each other. The first positioning plate is provided with the guide groove or the guide rail. The second positioning plate is provided with the guide rail or the guide groove mating with the guide groove or the guide rail of the first positioning plate. The second positioning plate slides along a certain track on the first positioning plate through the cooperation between the guide groove and the guide rail.

Wherein, the sliding mechanism includes rolling balls and a slide groove to cooperate with each other. The first positioning plate is provided with the slide groove. The second positioning plate is provided with the rolling balls. The second positioning plate slides on the first positioning plate through the rolling balls and the slide groove.

The present invention further provides the following technical solution.

A magnetic stapler comprises a base plate, a positioning plate, and a staple output device. The positioning plate is located between the base plate and the staple output device.

The positioning plate is transparent or non-transparent. The positioning plate is provided with a groove. The groove has a contour corresponding to that of a bottom of staple output device. A periphery of the positioning plate is provided with two or more first substances with attracting performance or attracted performance.

The base plate is provided with a plurality of second substances respectively corresponding to the first substances. The first substances and the second substances attract each other. The base plate is provided with a staple-crimping platform thereon. The bottom of the staple output device is provided with a staple dispensing outlet corresponding to a staple dispensing extremity of the staple output device. The position of the staple-crimping platform is opposite to the position of the staple dispensing outlet.

Wherein, the positioning plate is a movable structure.

Wherein, the positioning plate includes a first positioning plate and a second positioning plate. A sliding mechanism is provided between the first positioning plate and the second positioning plate. The first positioning plate is movably connected to the second positioning plate through the sliding mechanism.

Wherein, the sliding mechanism includes a guide rail and a guide groove to cooperate with each other. The first positioning plate is provided with the guide groove or the guide rail. The second positioning plate is provided with the guide rail or the guide groove mating with the guide groove or the guide rail of the first positioning plate. The second positioning plate slides along a certain track on the first positioning plate through the cooperation between the guide groove and the guide rail.

Wherein, the sliding mechanism includes rolling balls and a slide groove to cooperate with each other. The first positioning plate is provided with the slide groove. The second positioning plate is provided with the rolling balls. The second positioning plate slides on the first positioning plate through the rolling balls and the slide groove.

The sliding track can be set by setting the extending shape of the guide rail, the guide groove or the slide groove. In an embodiment, the first positioning plate is provided with a linear slide groove. The second positioning plate is provided with rolling balls mating with the slide groove of the first positioning plate. Because the slide groove is in the form of a straight line, the stapler can staple the paper sheets easily and continuously along the straight line.

In some technical solutions, the sliding mechanism further includes a telescopic guide rail accommodated in the guide groove, that is, the length of the guide rail is adjustable. For example, the first positioning plate is provided with the guide groove. The second positioning plate is provided with a guide rail having a telescopic function. The telescopic function allows the first positioning plate and the second positioning plate to slide relative to each other for a longer distance, so that the stapler can continuously staple the paper sheets along a longer straight distance.

In some technical solutions, the sliding mechanism includes a telescopic guide rail and a guide rail groove to accommodate the telescopic guide rail. The first positioning plate is provided with the guide rail groove. One end of the guide rail groove is provided with a buckle. The second positioning plate is provided with the telescopic guide rail. One end of the telescopic guide rail is provided with a buckle block. The buckle is in cooperation with the buckle block.

In additional, the telescopic guide rail may have a specific height. When the positioning plate 2 is placed on the base plate, the bottom end of the telescopic guide rail and the bottom end of the positioning plate are simultaneously in contact with the base plate, that is, the distance from the telescopic guide rail to the base plate 1 is equal to the distance from the positioning plate to the base plate.

Therefore, the arrangement of the telescopic guide rail has the following advantages. The movement distance of the first positioning plate is longer through the telescopic design. When the first positioning plate and the second positioning plate are moved to disengage from each other, the distance between the first positioning plate and the base plate won't be changed.

3. The Beneficial Effects of the Present Invention

Compared with the prior art, in the magnet stapler of the present invention, through the magnets of the base plate and the transparent positioning plate, the paper sheets are attracted between the two plates to precisely locate the stapling position. Then, the stapler is placed in the groove of the positioning plate for stapling the paper sheets. The contour of the groove of the positioning plate corresponds to the contour of the bottom of the stapler, so that the stapler can be freely placed in the groove, without deviation. This way improves the quality and efficiency of stapling the paper sheets. It is not easy to damage paper sheets or handmade paper products that require stapling.

The magnetic stapler of the present invention has many advantages, such as overall compactness, easy operation, strong practicability, and the like. The paper sheets can be stapled at any position as desired.

Figure 1:
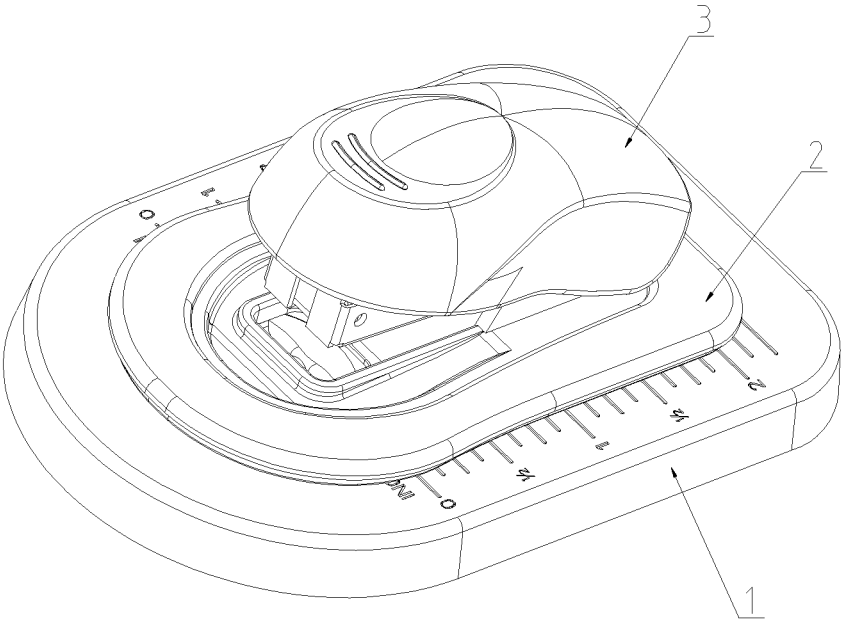
FIG. 1 is a perspective view of the magnetic stapler in accordance with a first embodiment of the present invention.
Figure 2:
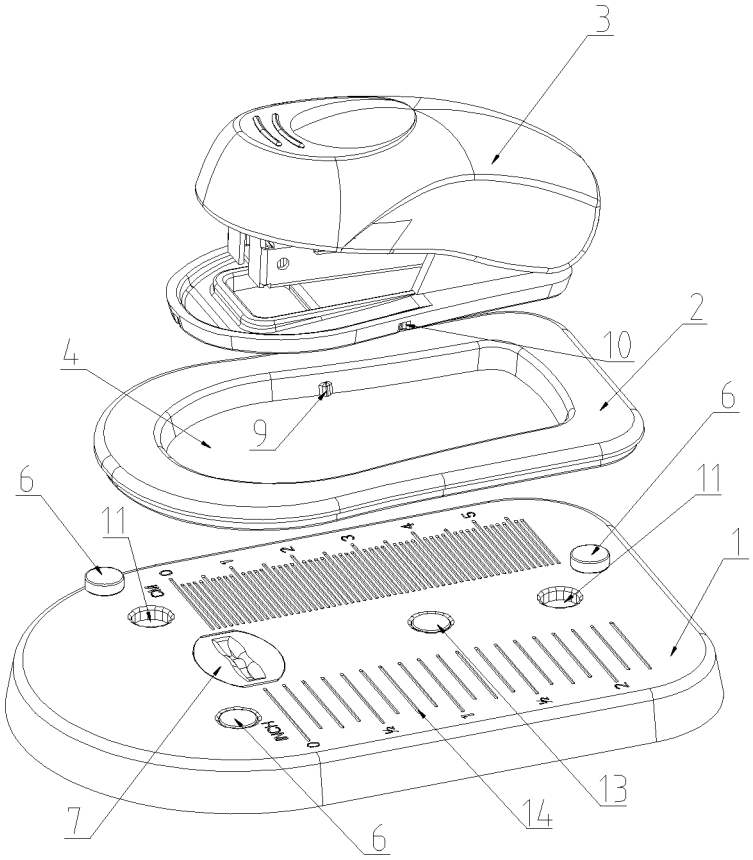
FIG. 2 is an exploded view of FIG. 1.
Figure 3:
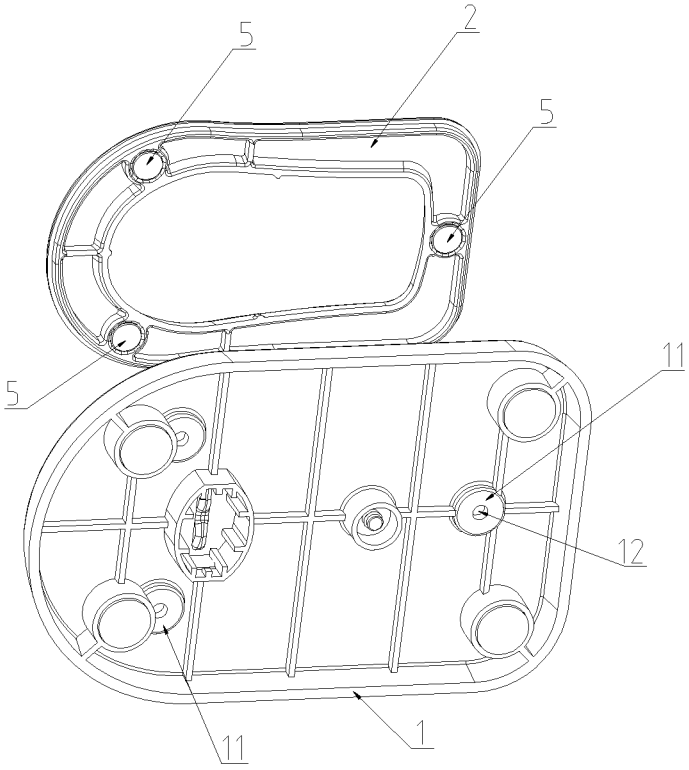
FIG. 3 is an exploded view of the base plate and the positioning plate of FIG. 1.
Figure 4:
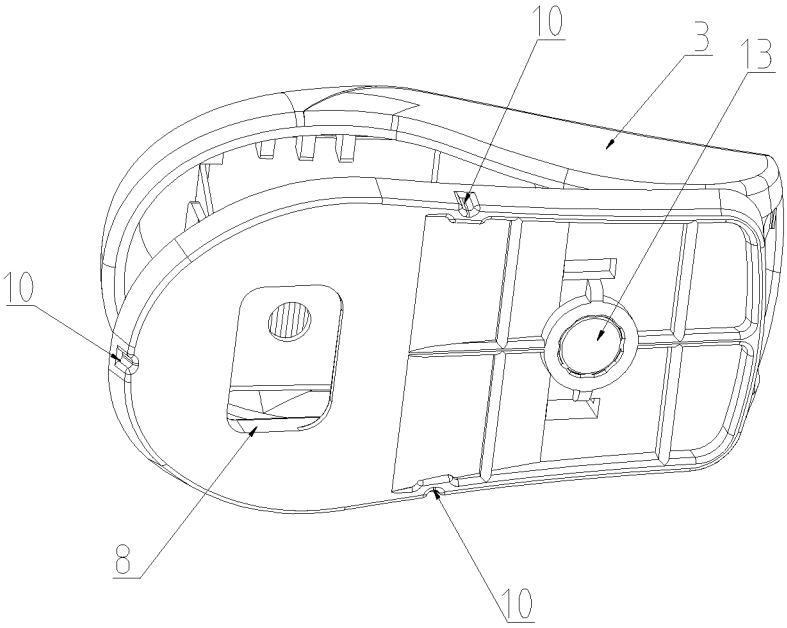
FIG. 4 is a schematic view of the stapler of FIG. 1.

Wherein:

(1) base plate; (2) positioning plate; (3) stapler; (4) groove; (5) first magnet; (6) second magnet; (7) staple-crimping platform; (8) staple dispensing outlet; (9) engaging protrusion; (10) engaging recess; (11) magnet accommodating cavity; (12) through hole; (13) magnet; (14) calibration line; (15) first positioning plate; (16) second positioning plate; (17) sliding mechanism; (18) guide rail; (19) guide groove; (20) slide groove; (21) rolling ball; (22) staple output device; (23) buckle; (24) buckle block; (25) telescopic guide rail; (26) guide rail groove; (27) first telescopic section; (28) second telescopic section

DESCRIPTION OF THE PREFERRED EMBODIMENTS

In order to understand the present invention, embodiments of the present invention will now be described, by way of example only, with reference to the accompanying drawings. The following embodiments are intended to illustrate the present invention but are not intended to limit the scope of the present invention.

First Embodiment

The structure of the magnetic stapler of this embodiment, as shown in FIG. 1 to FIG. 12, comprises a base plate 1, a positioning plate 2, and a stapler 3. The positioning plate 2 is located between the base plate 1 and the stapler 3.

When in use, through the magnets of the base plate 1 and the positioning plate 2, paper sheets are attracted between the two plates to precisely locate the stapling position. Then, the stapler 3 is placed in the groove of the positioning plate 2 for stapling the paper sheets.

Specifically, the positioning plate 2 is transparent. Through the magnets of the base plate 1 and the positioning plate 2, the paper sheets are attracted between the two plates to precisely locate the stapling position. A groove 4 is provided on the positioning plate 2. The contour of the groove 4 corresponds to the contour of the bottom of the stapler 3. The stapler 3 can be freely placed in the groove 4, without deviation, which is convenient for use. The periphery of the positioning plate 2 is provided with a plurality of first magnets 5. The base plate 1 is provided with a plurality of second magnets 6 respectively corresponding to the first magnets 5. The polarity of the second magnets 6 is opposite to that of the first magnets 5, and the number is the same. In this way, through the magnets 6 of the base plate 1 and the magnets 5 of the positioning plate 2, the paper sheets are attracted between the two plates to precisely locate the stapling position. A staple-crimping platform 7 is provided on the base plate 1. The bottom of the stapler 3 is provided with a staple dispensing outlet 8 corresponding to a staple dispensing extremity of the stapler 3. The position of the staple-crimping platform 7 is opposite to the position of the staple dispensing outlet 8 to achieve a stapling function.

In this embodiment, an inner side of the groove 4 is provided with a plurality of engaging protrusions 9. An outer side of the bottom of the stapler 3 is provided with a plurality of engaging recesses 10 corresponding to the engaging protrusions 9. The engaging protrusions 9 are engaged with the engaging recesses 10, allowing the stapler 3 to be quickly inserted into the groove 4 of the positioning plate 2. Alternatively, an inner side of the groove 4 is provided with a plurality of engaging recesses 10. An outer side of the bottom of the stapler 3 is provided with a plurality of engaging protrusions 9 corresponding to the engaging recesses 10. The engaging protrusions 9 are engaged with the engaging recesses 10.

The base plate 1 is provided with a plurality of magnet accommodating cavities 11 respectively corresponding to the second magnets 6. The second magnets 6 are embedded in the magnet accommodating cavities 11, respectively. The magnet accommodating cavities 11 not only play the role of accommodating the second magnets 6 but also protect the second magnets 6 from magnetic flux leakage. In order to facilitate disassembly of the second magnets 6, the bottom of each magnet accommodating cavity 11 is formed with a through hole 12. When the second magnets 6 are disassembled, the second magnets 6 can be easily pushed out by simply inserting a rod-shaped member into the through hole 12.

The base plate 1 and the bottom of the stapler 3 are respectively provided with magnets 13 corresponding in position to each other and attracting each other. The pair of magnets 13 provides a guide function, that is, the stapler 3 is quickly placed in the groove 4 of the positioning plate 2 by a certain magnetic force.

The base plate 1 is provided with calibration lines 14. The calibration lines 14 are arranged close to both side edges of the base plate 1 for assisting the placement of the paper sheets.

Accordingly, in this embodiment, through the small stapler, any position of the paper sheets can be stapled. The binding position is precise without deviation. The magnets of the positioning plate and the base plate attract each to retain the binding position of the paper sheets. The stapler can be placed in the groove of the positioning plate to staple the paper sheets. The staple size used for the magnetic stapler of this embodiment may be 24/6 and 26/6. The maximum number of the paper sheets is 8.

As described above, for the magnetic stapler of the present invention, through the magnets of the base plate and the transparent positioning plate, the paper sheets are attracted between the two plates to precisely locate the stapling position. Then, the stapler is placed in the groove of the positioning plate for stapling the paper sheets. The contour of the groove of the positioning plate corresponds to the contour of the bottom of the stapler, so that the stapler can be freely placed in the groove, without deviation. This way improves the quality and efficiency of stapling the paper sheets. It is not easy to damage paper sheets or handmade paper products that require stapling.

Figure 5:
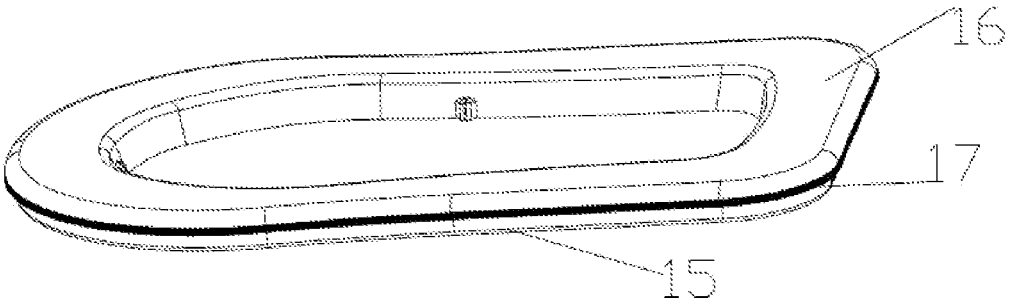
FIG. 5 is a schematic view of the positioning plate of the magnetic stapler in accordance with a second embodiment and a third embodiment of the present invention.
Figure 6:
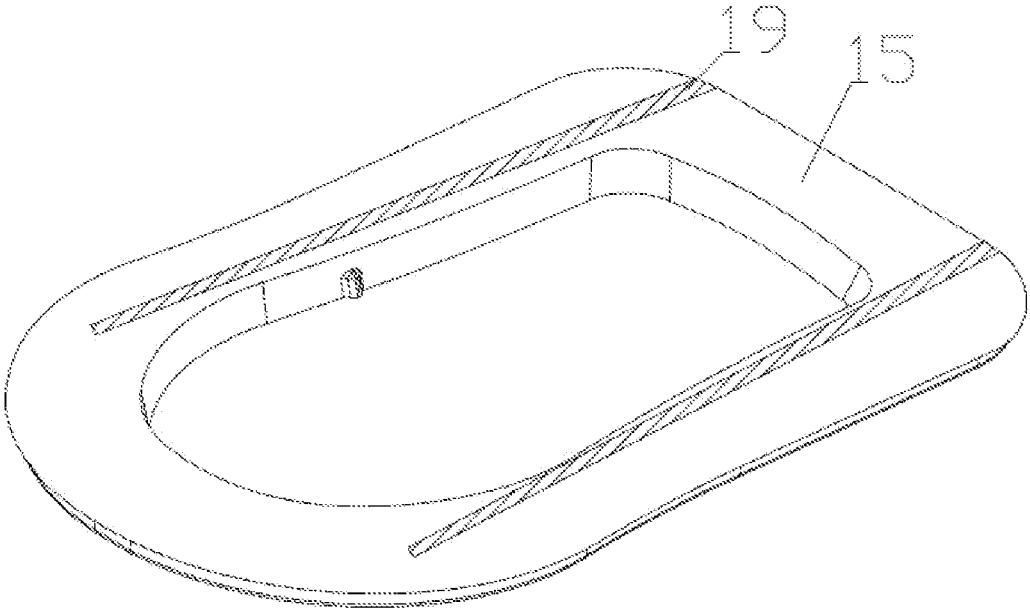
FIG. 6 is a schematic view of the first positioning plate with the guide groove in accordance with the second embodiment of the present invention.
Figure 7:
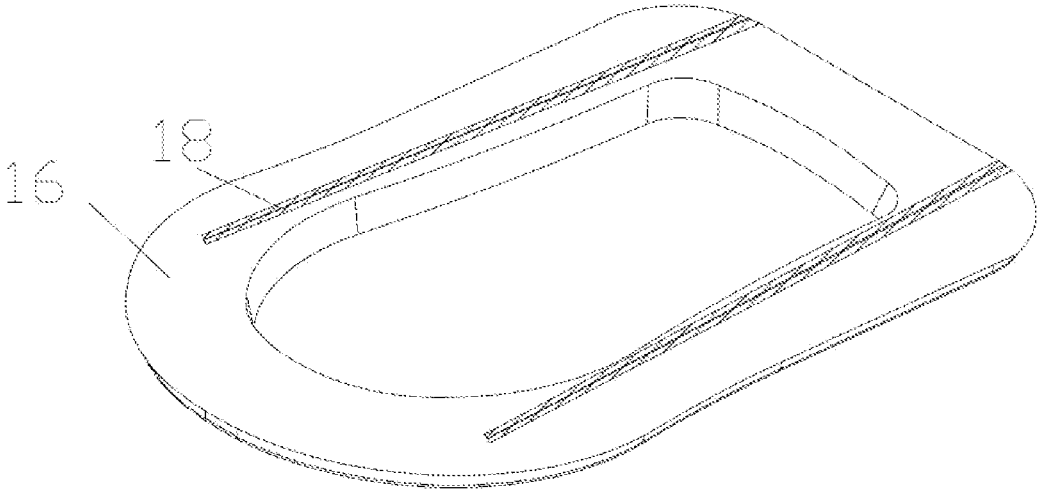
FIG. 7 is a schematic view of the second positioning plate with the guide rail in accordance with the second embodiment of the present invention.

When multiple stapling operations are required in the same direction, a first positioning plate 15 is movably connected to a second positioning plate 16 through a sliding mechanism 17. The sliding mechanism 17 includes the following structure:

1. As shown in FIG. 5, FIG. 6, and FIG. 7, a guide groove or a guide rail is provided on the first positioning plate 15, and the second positioning plate 16 is provided with a guide rail 18 or a guide groove 19 mating with the guide groove or the guide rail of the first positioning plate 15. Through the cooperation between the guide groove 19 and the guide rail 18, the second positioning plate 16 can slide back and forth in the same direction on the first positioning plate 15. This reduces the need to repeatedly locate the stapling position when it is necessary to staple the paper sheets many times in the same direction, and improves the accuracy of the stapling. It is convenient for use and operation.

Figure 8:
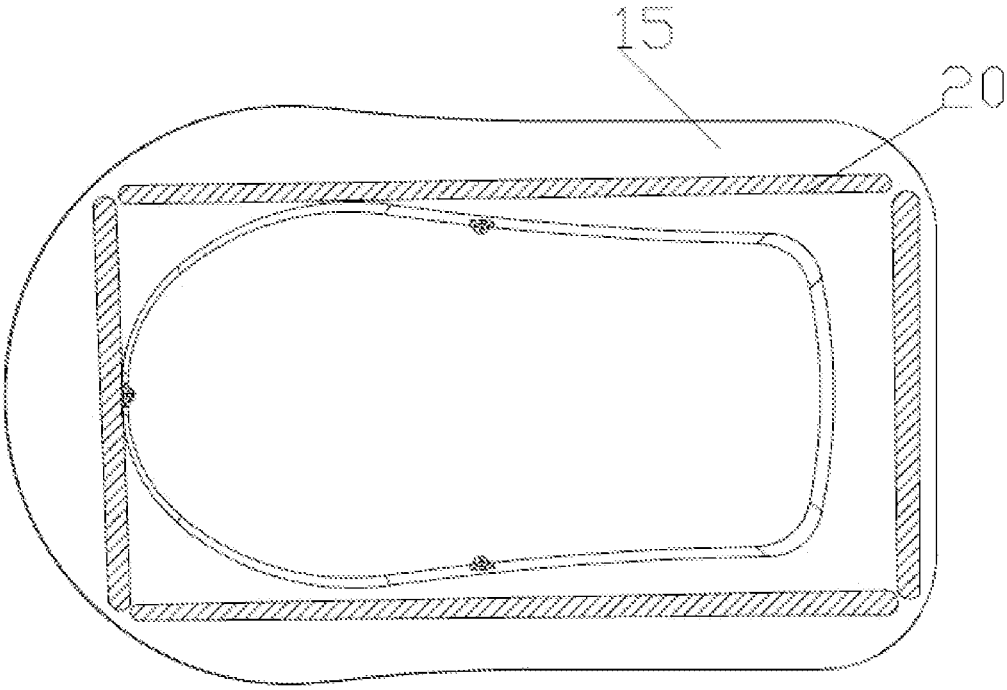
FIG. 8 is a schematic view of the first positioning plate with the slide groove in accordance with the second embodiment of the present invention.
Figure 9:
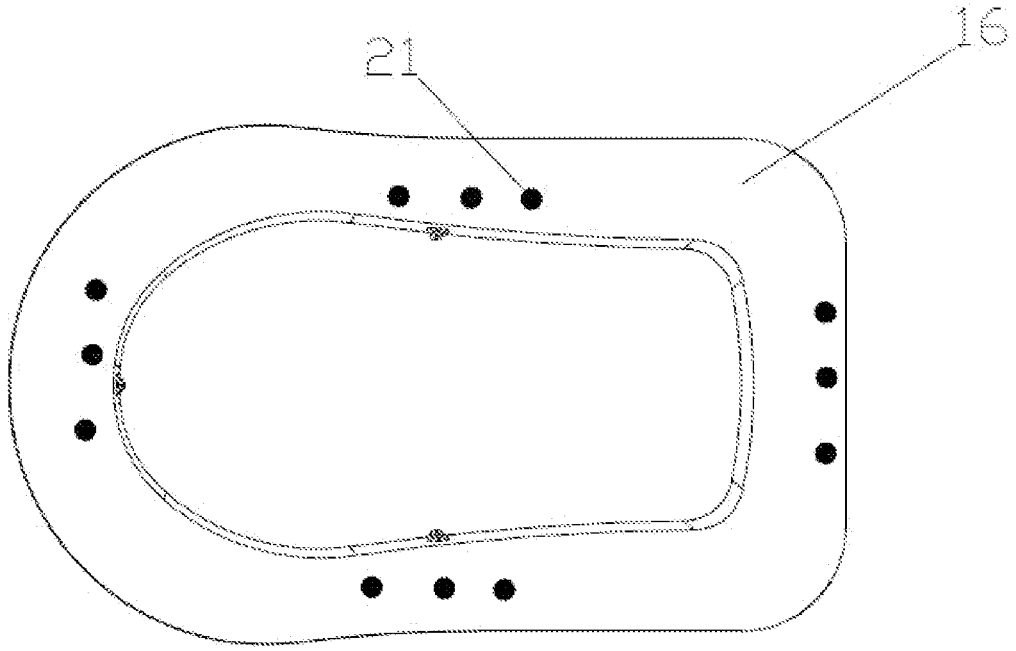
FIG. 9 is a schematic view of the second positioning plate with the rolling balls in accordance with the second embodiment of the present invention.
Figure 10:
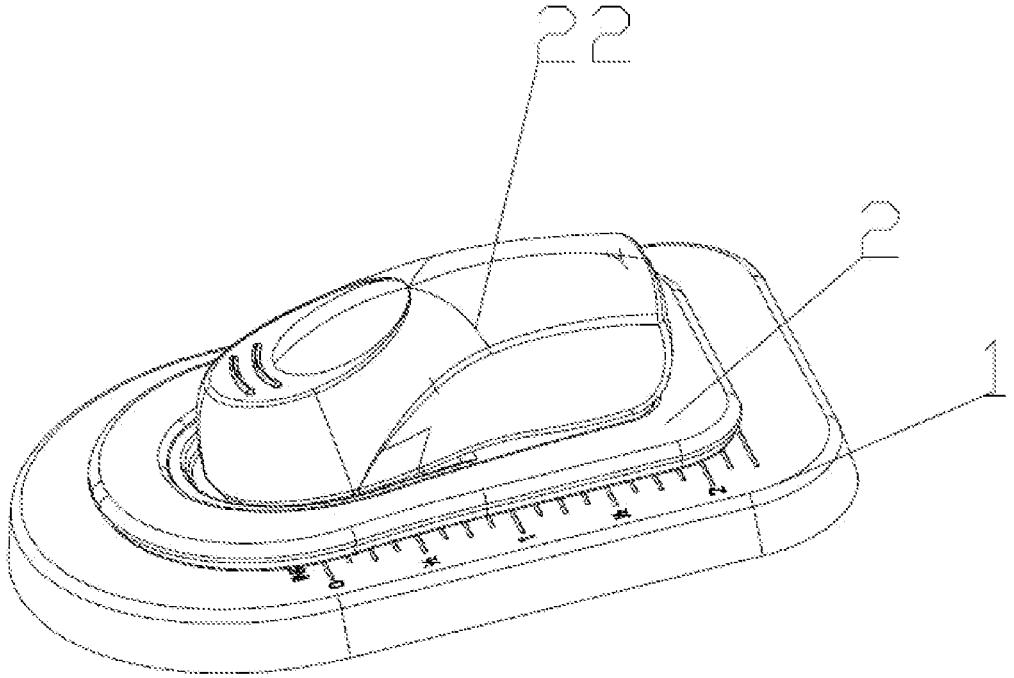
FIG. 10 is a schematic view showing the overall structure of the magnetic stapler according to the embodiments of the present invention (in a press state)
Figure 11:
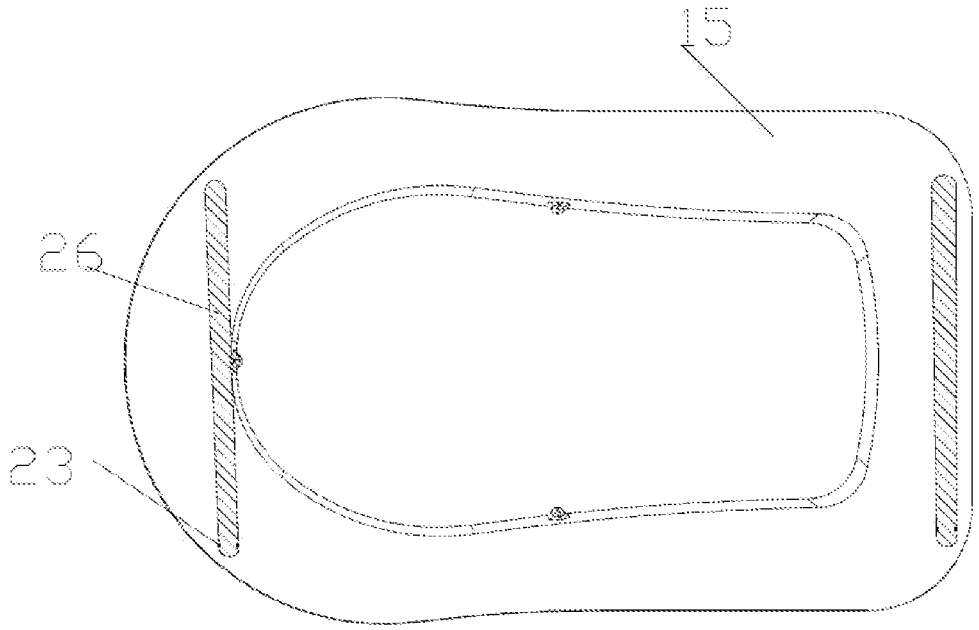
FIG. 11 is a schematic view of the first positioning plate with the guide rail groove in accordance with the third embodiment of the present invention.
Figure 12:
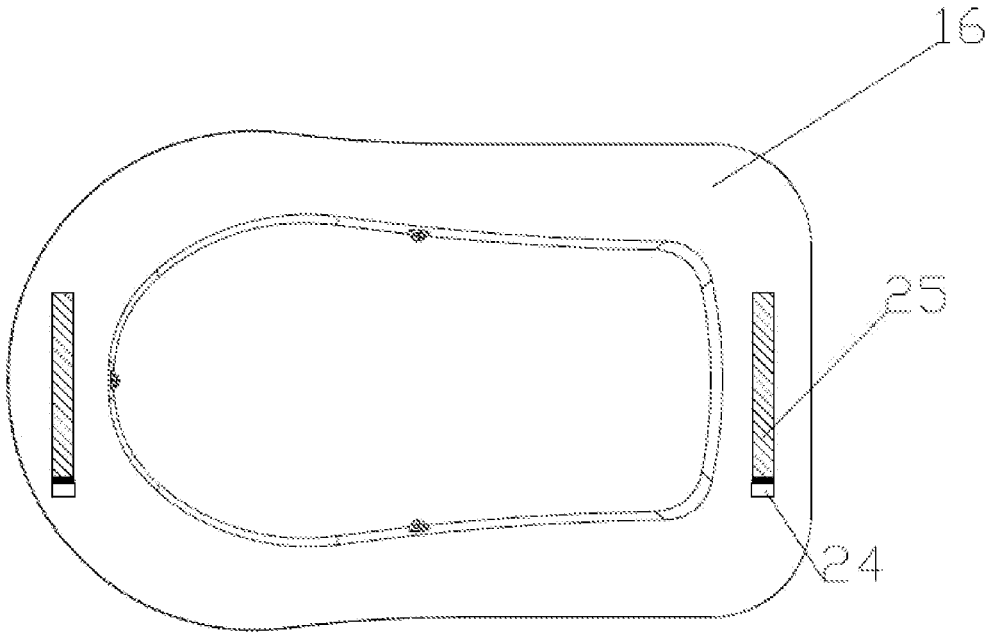
FIG. 12 is a schematic view of the second positioning plate with the telescopic guide rail in accordance with the third embodiment of the present invention.
Figure 13:
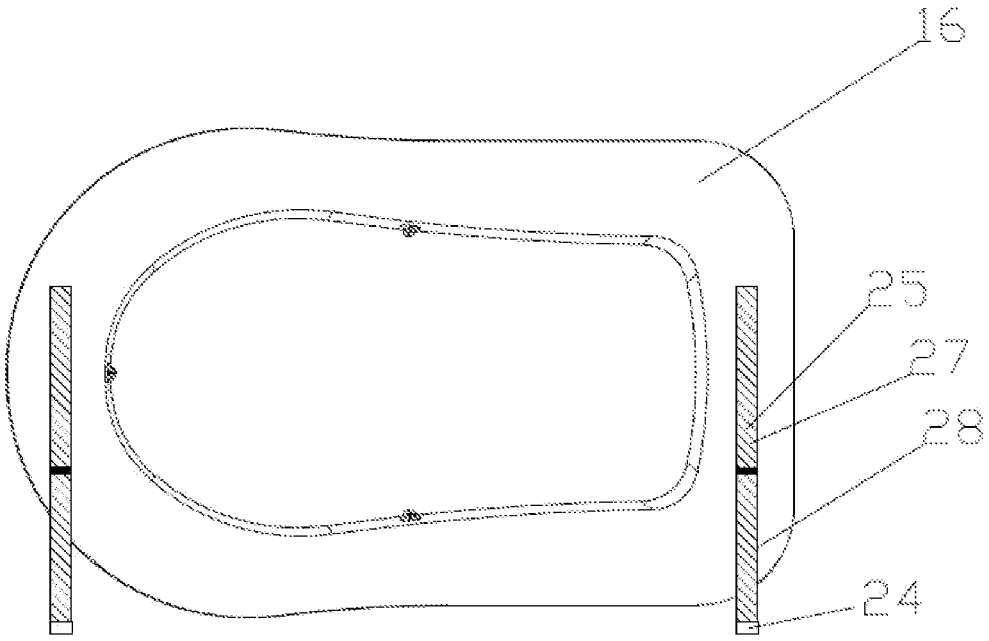
FIG. 13 is a schematic view of the second positioning plate with the telescopic guide rail in an unfolded state in accordance with the third embodiment of the present invention.

2. As shown in FIG. 5, FIG. 8, and FIG. 9, the first positioning plate 15 is formed with a slide groove 20. The second positioning plate 16 is provided with rolling balls 21. Through the rolling balls 21 and the slide groove 20, the second positioning plate 16 can slide back and forth as well as left and right on the first positioning plate 15 to slide in multiple directions. This reduces the time required to locate the stapling position many times when the paper sheets are stapled many times in the same direction, reduces work intensity, reduces the work cost, will not lead to deviations, and improves the accuracy of the stapling. It is convenient for use.

The magnetic stapler of the present invention has many advantages, such as overall compactness, easy operation, strong practicability, and the like. The paper sheets can be stapled at any position as desired.

Second Embodiment

As shown in FIG. 10, FIG. 5, FIG. 6, FIG. 7, FIG. 8 and FIG. 9, a magnetic stapler is characterized in that the magnetic stapler comprises a base plate 1, a positioning plate 2, and a staple output device 22. The positioning plate 2 is located between the base plate 1 and the staple output device 22.

The positioning plate 2 is transparent or non-transparent. A groove 4 is provided on the positioning plate 2. The contour of the groove 4 corresponds to the contour of the bottom of the staple output device 22. The periphery of the positioning plate 2 is provided with two or more first magnets 5.

The base plate 1 is provided with a plurality of iron members or second magnets 6 respectively corresponding to the first magnets or iron members 5. The polarity of the second magnets 6 is opposite to that of the first magnets 5. A staple-crimping platform 7 is provided on the base plate 1. The bottom of the staple output device 22 is provided with a staple dispensing outlet 8 corresponding to a staple dispensing extremity of the staple output device 22. The position of the staple-crimping platform 7 is opposite to the position of the staple dispensing outlet 8.

The positioning plate 2 relative to the staple output device 22 is a movable structure. The positioning plate 2 includes a first positioning plate 15 and a second positioning plate 16. A sliding mechanism 17 is provided between the first positioning plate 15 and the second positioning plate 16. The first positioning plate 15 is movably connected to the second positioning plate 16 through the sliding mechanism 17.

When in use, through the magnets of the base plate 1 and the positioning plate 2, paper sheets are attracted between the two plates to precisely locate the stapling position. Then, the staple output device 22 is placed in the groove of the positioning plate 2 for stapling the paper sheets. Due to the movable structure of the positioning plate 2, the staple output device 22 located on the positioning plate 2 can accurately locate the stapling position and staple the paper sheets many times along with the positioning plate 2.

Specifically, the positioning plate 2 is transparent or non-transparent. Through the magnets of the base plate 1 and the transparent or non-transparent first positioning plate 15, the paper sheets are attracted between the two plates to accurately locate the stapling position. The second positioning plate 16 is provided with the groove 4. The contour of the groove 4 corresponds to the contour of the bottom of the staple output device 22. For the contour of the bottom of the staple output device 22 to fit the groove 4 of the second positioning plate 16 better, the staple output device 22 partially extends outward in a concave shape. The staple output device 22 can be freely inserted without deviation. It is convenient for use. The periphery of the first positioning plate 15 is provided with a plurality of first magnets 5. When multiple stapling operations are required in the same direction, a first positioning plate 15 is movably connected to a second positioning plate 16 through a sliding mechanism 17. The sliding mechanism 17 includes the following structure:

1. As shown in FIG. 5, FIG. 6, and FIG. 7, a guide groove or a guide rail is provided on the first positioning plate 15, and the second positioning plate 16 is provided with a guide rail 18 or a guide groove 19 mating with the guide groove or the guide rail of the first positioning plate 15. Through the cooperation between the guide groove 19 and the guide rail 18, the second positioning plate 16 can slide back and forth in the same direction on the first positioning plate 15. This reduces the need to repeatedly locate the stapling position when the paper sheets are stapled many times in the same direction and improves the accuracy of the stapling. It is convenient for use and operation.

2. As shown in FIG. 5, FIG. 8, and FIG. 9, the first positioning plate 15 is formed with a slide groove 20. The second positioning plate 16 is provided with rolling balls 21. Through the rolling balls 21 and the slide groove 20, the second positioning plate 16 can slide back and forth as well as left and right on the first positioning plate 15 to slide in multiple directions. This reduces the time required to locate the stapling position many times when the paper sheets are stapled many times in the same direction, reduces work intensity, reduces the work cost, will not lead to deviations, and improves the accuracy of the stapling. It is convenient for use.

The base plate 1 is provided with a plurality of second substances 6 respectively corresponding to the first substances 5. The polarity of the second substances 6 is opposite to that of the first substances 5, and the number is the same. In this way, through the second substances 6 of the base plate 1 and the first substances 5 of the transparent or non-transparent first positioning plate 2, the paper sheets can be attracted between the two plates so as to achieve a precise stapling positioning. A staple-crimping platform 7 is provided on the base plate 1. The bottom of the staple output device 22 is provided with a staple dispensing outlet 8 corresponding to a staple dispensing extremity of the staple output device 22. The position of the staple-crimping platform 7 is opposite to the position of the staple dispensing outlet 8 to achieve a stapling function.

When the first substance 5 is a magnet, the second substance 6 may be a magnet or iron member. When the first substance 5 is an iron member, the second substance 6 is a magnet.

In this application, the stapler 3 of the first embodiment is equivalent to the staple output device 22 of the second embodiment.

Third Embodiment

As shown in FIG. 5, FIG. 11, FIG. 12, and FIG. 13, this embodiment is substantially similar to the first embodiment with the exceptions described hereinafter. The sliding mechanism 17 includes a telescopic guide rail 25 and a guide rail groove 26 to accommodate the telescopic guide rail 25. The first positioning plate 15 is provided with the guide rail groove 26. One end of the guide rail groove 26 is provided with a buckle 23. The second positioning plate 16 is provided with the telescopic guide rail 25. One end of the telescopic guide rail 25 is provided with a buckle block 24. The buckle 23 is in cooperation with the buckle block 24.

Specifically, the telescopic guide rail 25 includes a first telescopic section 27 that is fixedly connected to the second positioning plate 16 and a second telescopic section 28 that is slidable relative to the first telescopic section 27. The buckle 23 is disposed on the second telescopic section 28. When the first positioning plate 15 cooperates with the second positioning plate 16 to form the positioning plate as a whole, the first telescopic section 27 and the second telescopic section 28 are in a folded state and received in the guide rail groove 26. When the first positioning plate 15 and the second positioning plate 16 are moved to separate from each other, the first telescopic section 27 and the second telescopic section 28 are slid apart from each other.

In addition, the telescopic guide rail 25 may have a specific height. When the positioning plate 2 is placed on the base plate 1, the bottom end of the telescopic guide rail 25 and the bottom end of the positioning plate 2 are simultaneously in contact with the base plate 1, that is, the distance from the telescopic guide rail 25 to the base plate 1 is equal to the distance from the positioning plate 2 to the base plate 1.

Therefore, through the arrangement of the telescopic guide rail 25, this embodiment has the following advantages. The movement distance of the first positioning plate 15 is longer through the telescopic design. When the first positioning plate 15 and the second positioning plate 16 are moved to disengage from each other, the distance between the first positioning plate 15 and the base plate 1 won't be changed.

During operation, the second positioning plate 16 is laterally slid along the guide rail groove 26 on the first positioning plate 15 through the telescopic guide rail 25 until the buckle 23 is in contact with the buckle block 24. Since the second positioning plate 16 is provided with the telescopic guide rail 25, the first positioning plate 15 and the second positioning plate 16 can be moved to disengage from each other, without affecting the accuracy of stapling the paper sheets.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A magnetic stapler, comprising a base plate (1), a positioning plate (2) and a stapler (3), the positioning plate (2) being located between the base plate (1) and the stapler (3);

the positioning plate (2) being transparent, a groove (4) being provided on the positioning plate (2), the groove (4) having a contour corresponding to that of a bottom of the stapler (3); a periphery of the positioning plate (2) being provided with a plurality of first magnets (5);

the base plate (1) being provided with a plurality of second magnets (6) respectively corresponding to the first magnets (5), the second magnets (6) having a polarity opposite to that of the first magnets (5), the base plate (1) being provided with a staple-crimping platform (7) thereon, the bottom of the stapler (3) being provided with a staple dispensing outlet (8) corresponding to a staple dispensing extremity of the stapler (3), the position of the staple-crimping platform (7) being opposite to the position of the staple dispensing outlet (8).

2. The magnetic stapler as claimed in claim 1, wherein an inner side of the groove (4) is provided with a plurality of engaging protrusions (9), an outer side of the bottom of the stapler (3) is provided with a plurality of engaging recesses (10) corresponding to the engaging protrusions (9), and the engaging protrusions (9) are engaged with the engaging recesses (10).

3. The magnetic stapler as claimed in claim 1, wherein an inner side of the groove (4) is provided with a plurality of engaging recesses (10), an outer side of the bottom of the stapler (3) is provided with a plurality of engaging protrusions (9) corresponding to the engaging recesses (10), and the engaging protrusions (9) are engaged with the engaging recesses (10).

4. The magnetic stapler as claimed in claim 2 or 3, wherein the base plate (1) is provided with a plurality of magnet accommodating cavities (11) respectively corresponding to the second magnets (6), and the second magnets (6) are embedded in the magnet accommodating cavities (11), respectively.

5. The magnetic stapler as claimed in claim 4, wherein the magnet accommodating cavities (11) each have a through hole (12) at a bottom thereof for disassembling a corresponding one of the second magnets (6).

6. The magnetic stapler as claimed in claim 4, wherein the base plate (1) and the bottom of the stapler (3) are respectively provided with magnets (13) corresponding in position to each other and attracting each other.

7. The magnetic stapler as claimed in claim 4, wherein the base plate (1) is provided with calibration lines (14), and the calibration lines (14) are arranged close to both side edges of the base plate (1).

8. The magnetic stapler as claimed in claim 1, wherein the positioning plate (2) is a movable structure.

9. The magnetic stapler as claimed in claim 8, wherein the positioning plate (2) includes a first positioning plate (15) and a second positioning plate (16), a sliding mechanism (17) is provided between the first positioning plate (15) and the second positioning plate (16), and the first positioning plate (15) is movably connected to the second positioning plate (16) through the sliding mechanism (17).

10. The magnetic stapler as claimed in claim 9, wherein the sliding mechanism (17) includes a guide rail (18) and a guide groove (19) to cooperate with each other, the first positioning plate (15) is provided with the guide groove (19) or the guide rail (18), the second positioning plate (16) is provided with the guide rail (18) or the guide groove (19) mating with the guide groove (19) or the guide rail (18) of the first positioning plate (15), and the second positioning plate (16) slides along a certain track on the first positioning plate (15) through the cooperation between the guide groove (19) and the guide rail (18).

11. The magnetic stapler as claimed in claim 9, wherein the sliding mechanism (17) includes rolling balls (21) and a slide groove (20) to cooperate with each other, the first positioning plate (15) is provided with the slide groove (20), the second positioning plate (16) is provided with the rolling balls (21), and the second positioning plate (16) slides on the first positioning plate (15) through the rolling balls (21) and the slide groove (20).

12. The magnetic stapler as claimed in claim 9, wherein the sliding mechanism (17) includes a telescopic guide rail (25) and a guide rail groove (26) to accommodate the telescopic guide rail (25), the first positioning plate (15) is provided with the guide rail groove (26), one end of the guide rail groove (26) is provided with a buckle (23), the second positioning plate (16) is provided with the telescopic guide rail (25), one end of the telescopic guide rail (25) is provided with a buckle block (24), and the buckle (23) is in cooperation with the buckle block (24).

13. The magnetic stapler as claimed in claim 12, wherein the telescopic guide rail (25) includes a first telescopic section (27) that is fixedly connected to the second positioning plate (16) and a second telescopic section (28) that is slidable relative to the first telescopic section (27); and the buckle (23) is disposed on the second telescopic section (28).

14. A magnetic stapler, comprising a base plate (1), a positioning plate (2) and a staple output device (22), the positioning plate (2) being located between the base plate (1) and the staple output device (22);

the positioning plate (2) being provided with a groove (4), the groove (4) having a contour corresponding to that of a bottom of staple output device (22); a periphery of the positioning plate (2) being provided with two or more first substances (5) with attracting performance or attracted performance;

the base plate (1) being provided with a plurality of second substances (6) respectively corresponding to the first substances (5), the first substances (5) and the second substances (6) attracting each other; the base plate (1) being provided with a staple-crimping platform (7) thereon, the bottom of the staple output device (22) being provided with a staple dispensing outlet (8) corresponding to a staple dispensing extremity of the staple output device (22), the position of the staple-crimping platform (7) being opposite to the position of the staple dispensing outlet (8).

15. The magnetic stapler as claimed in claim 14, wherein the positioning plate (2) is a movable structure.

16. The magnetic stapler as claimed in claim 15, wherein the positioning plate (2) includes a first positioning plate (15) and a second positioning plate (16), a sliding mechanism (17) is provided between the first positioning plate (15) and the second positioning plate (16), and the first positioning plate (15) is movably connected to the second positioning plate (16) through the sliding mechanism (17).

17. The magnetic stapler as claimed in claim 16, wherein the sliding mechanism (17) includes a guide rail (18) and a guide groove (19) to cooperate with each other, the first positioning plate (15) is provided with the guide groove (19) or the guide rail (18), the second positioning plate (16) is provided with the guide rail (18) or the guide groove (19) mating with the guide groove (19) or the guide rail (18) of the first positioning plate (15), and the second positioning plate (16) slides along a certain track on the first positioning plate (15) through the cooperation between the guide groove (19) and the guide rail (18).

18. The magnetic stapler as claimed in claim 16, wherein the sliding mechanism (17) includes rolling balls (21) and a slide groove (20) to cooperate with each other, the first positioning plate (15) is provided with the slide groove (20), the second positioning plate (16) is provided with the rolling balls (21), and the second positioning plate (16) slides on the first positioning plate (15) through the rolling balls (21) and the slide groove (20).

19. The magnetic stapler as claimed in claim 16, wherein the sliding mechanism (17) includes a telescopic guide rail (25) and a guide rail groove (26) to accommodate the telescopic guide rail (25), the first positioning plate (15) is provided with the guide rail groove (26), one end of the guide rail groove (26) is provided with a buckle (23), the second positioning plate (16) is provided with the telescopic guide rail (25), one end of the telescopic guide rail (25) is provided with a buckle block (24), and the buckle (23) is in cooperation with the buckle block (24).

20. The magnetic stapler as claimed in claim 19, wherein the telescopic guide rail (25) includes a first telescopic section (27) that is fixedly connected to the second positioning plate (16) and a second telescopic section (28) that is slidable relative to the first telescopic section (27); and the buckle (23) is disposed on the second telescopic section (28).

* * * * *